US008747006B2

(12) United States Patent
Payne

(10) Patent No.: US 8,747,006 B2
(45) Date of Patent: Jun. 10, 2014

(54) FLAT BOX FINISHER

(75) Inventor: Robert Payne, Lombard, IL (US)

(73) Assignee: Drywall Master Tool, Inc., Forest Park, IL (US)

( * ) Notice: Subject to any disclaimer, the term of this patent is extended or adjusted under 35 U.S.C. 154(b) by 734 days.

(21) Appl. No.: 12/964,421

(22) Filed: Dec. 9, 2010

(65) Prior Publication Data

US 2011/0139068 A1 Jun. 16, 2011

Related U.S. Application Data

(60) Provisional application No. 61/283,945, filed on Dec. 11, 2009.

(51) Int. Cl.
*A47L 13/26* (2006.01)

(52) U.S. Cl.
USPC ..... 401/139; 401/265; 401/137; 425/87

(58) Field of Classification Search
USPC ..... 401/48, 158, 265, 136, 137, 139, 261; 118/263; 425/87
See application file for complete search history.

(56) References Cited

U.S. PATENT DOCUMENTS

| | | | | |
|---|---|---|---|---|
| 2,711,098 | A * | 6/1955 | Ames | 401/6 |
| 3,451,757 | A * | 6/1969 | Vaughan et al. | 401/139 |
| 5,143,264 | A * | 9/1992 | MacMillan | 401/48 |
| 7,806,613 | B2 * | 10/2010 | Mondloch et al. | 401/48 |

* cited by examiner

*Primary Examiner* — David Walczak
*Assistant Examiner* — Bradley Oliver
(74) *Attorney, Agent, or Firm* — Justin Lampel

(57) ABSTRACT

The invention generally relates to a flat box finisher for applying mud (or mastic or joint compound) over taped joints on walls and ceilings. Usually, paint or wallpaper is then applied over the finished mud. The flat box finisher has no external springs, but has at least one internal support bar which acts as a spring for applying pressure to a corresponding dry wall finishing handle affixed to the flat box finisher. The internal support bar is surrounded by the mud while the device is in use. As a result of having no external spring, the flat box finisher may be reduced in size for smaller jobs or difficult to reach areas of a room. The internal support bar may also eliminate problems with external springs, such as the spring wearing out or becoming damaged during use or storage.

18 Claims, 6 Drawing Sheets

FLAT BOX FINISHER

CROSS REFERENCE TO RELATED APPLICATIONS

The present application claims the priority benefit of U.S. Provisional Application 61/283,945, filed on Dec. 11, 2009, which is hereby incorporated by reference in its entirety.

BACKGROUND OF THE INVENTION

The invention generally relates to a flat box finisher for applying mud (or mastic or joint compound) over taped joints on walls and ceilings. Usually, paint or wallpaper is then applied over the finished mud. The flat box finisher has no external springs, but has at least one internal support bar which acts as a spring for applying pressure to a corresponding dry wall finishing handle affixed to the flat box finisher. The internal support bar is surrounded by the mud while the device is in use. As a result of having no external spring, the flat box finisher may be reduced in size for smaller jobs or difficult to reach areas of a room. The internal support bar may also eliminate problems with external springs, such as the spring wearing out or becoming damaged during use or storage.

Flat box finishers have been around for a long time. For example, U.S. Pat. No. 7,318,716 to Castagnetta discloses a tool for applying mastic to drywall, having a flexible trowelling bar for smoothing and shaping the applied mastic. The curvature of the trowelling bar is controlled by the rotation of a cam that is positioned on a rigid support and that is directly coupled to the trowelling bar through a link. Springs are positioned between the rigid support and the trowelling bar to maintain tension on the link during rotation of the cam. The springs exert pressure on the trowelling bar through plungers having rounded feet that maintain consistent contact with the trowelling bar as the curvature of the trowelling bar changes.

U.S. Pat. No. 6,146,039 to Pool discloses a mud box having a bottom surface with an outlet orifice, sides, a cover pivotally attached along one edge, and a handle attached to the cover for positioning the box on a surface and applying extruding pressure to the cover for ejecting material through the orifice. A spring assembly is attached to the box and connected to apply extruding pressure to the cover. A primary lock is coupled to the spring assembly and the box, the primary lock has a locked position in which the spring assembly is prevented from applying extruding pressure to the cover and an unlocked position in which the spring assembly applies extruding pressure to the cover. The primary lock is activated by a wheel assembly which moves it into the locked position when the box and wheel assembly are disengaged from a surface and which moves it into the unlocked position when the wheel assembly and box are engaged with a surface.

U.S. Pat. No. 5,143,264 to MacMillan discloses a flat finishing box having attachable/detachable heads each of which have a structural part incorporating a mouth and to which an edge assembly and edge assembly adjustment apparatus are attached. Heads are provided for dispensing mud in each of the three standard swath widths, 7", 10" and 12", so that any swath width can be dispensed from one box by interchanging heads attached to the box. The box cover is one extrusion and the bottom and back are another. The hinged edge of the cover has a cylindrical segment along the edge which fits into a partial cylindrical groove in the back, providing a leak proof hinge. Channels are provided to enhance mud flow from portions of the box beyond the width of the mouth of the head being used to the portion within the mouth width.

However, these existing flat box finishers fail to provide an internal support bar which acts as a spring and allows the top surface area of the flat box finisher to be reduced while still accommodating the surface area of the handle connector portion. Further, these existing flat box finishers fail to provide an internal support bar which acts as a spring therein making the device cost effective and efficient. A need, therefore, exists for an improved flat box finisher which allows a user to easily, cheaply and conveniently apply mud to a limited area around tape while preparing drywall.

SUMMARY OF THE INVENTION

The invention generally relates to a flat box finisher for applying mud (or mastic or joint compound) over taped joints on walls and ceilings. Usually, paint or wallpaper is then applied over the finished mud. The flat box finisher has no external springs, but has at least one internal support bar which acts as a spring for applying pressure to a corresponding dry wall finishing handle affixed to the flat box finisher. The internal support bar is surrounded by the mud while the device is in use. As a result of having no external spring, the flat box finisher may be reduced in size for smaller jobs or difficult to reach areas of a room. The internal support bar may also eliminate problems with external springs, such as the spring wearing out or becoming damaged during use or storage.

In term is of using the device, a user will apply a first coat (bed coat) over a joint between drywall panels. Once the mud (or mastic) dries, a box flat box finisher is used to apply the second coat (finish coat) over the first coat. A third flat box is then used to apply a final coat (skim coat) over the finish coat. In order to control the flat box finisher, a flat finisher handle is attached to the flat box finisher. Loading of the flat box finisher handle onto the flat box finisher is quick and easy with a loading pump and filler adapter.

An advantage of the device is to provide a light weight and convenient flat box finisher for drywall.

A further advantage of the device is to provide a flat box finisher which lacks an external spring.

Yet another advantage of the device is to provide a flat box finisher which has a border on a top plate wherein the border does not cover an entire perimeter of the top plate.

Still another advantage of the device is to provide a flat box finisher which has a movable rolling bar which allows the device to smoothly roll on a working surface without damaging the same.

And another advantage of the device is to provide a flat box finisher which has a trowelling bar for smoothing mud on a wall after mud exits the device while work is performed.

Yet another advantage of the device is to provide a flat box finisher having a trowelling bar which has a plurality of slits for allowing the trowelling bar to bend easily under pressure.

Another advantage of the device is to provide a flat box finisher which can be constructed with a small top plate surface area and still be mounted on a standard flat box finishing handle.

A further advantage of the device is to provide a flat box finisher which is resistant to damage.

A still further advantage is to provide a flat box finisher which may be made in almost any size.

For a more complete understanding of the above listed features and advantages of the flat box finisher, reference should be made to the following detailed description of the preferred embodiments and to the accompanying drawings. Further, additional features and advantages of the invention are described in, and will be apparent from, the detailed description of the preferred embodiments and from the drawings.

DETAILED DESCRIPTION OF THE PREFERRED EMBODIMENTS

The invention generally relates to a flat box finisher for applying mud (or mastic or joint compound) over taped joints on walls and ceilings. Usually, paint or wallpaper is then applied over the finished mud. The flat box finisher has no external springs, but has at least one internal support bar which acts as a spring for applying pressure to a corresponding dry wall finishing handle affixed to the flat box finisher. The internal support bar is surrounded by the mud while the device is in use. As a result of having no external spring, the flat box finisher may be reduced in size for smaller jobs or difficult to reach areas of a room. The internal support bar may also eliminate problems with external springs, such as the spring wearing out or becoming damaged during use or storage.

Figure 1:
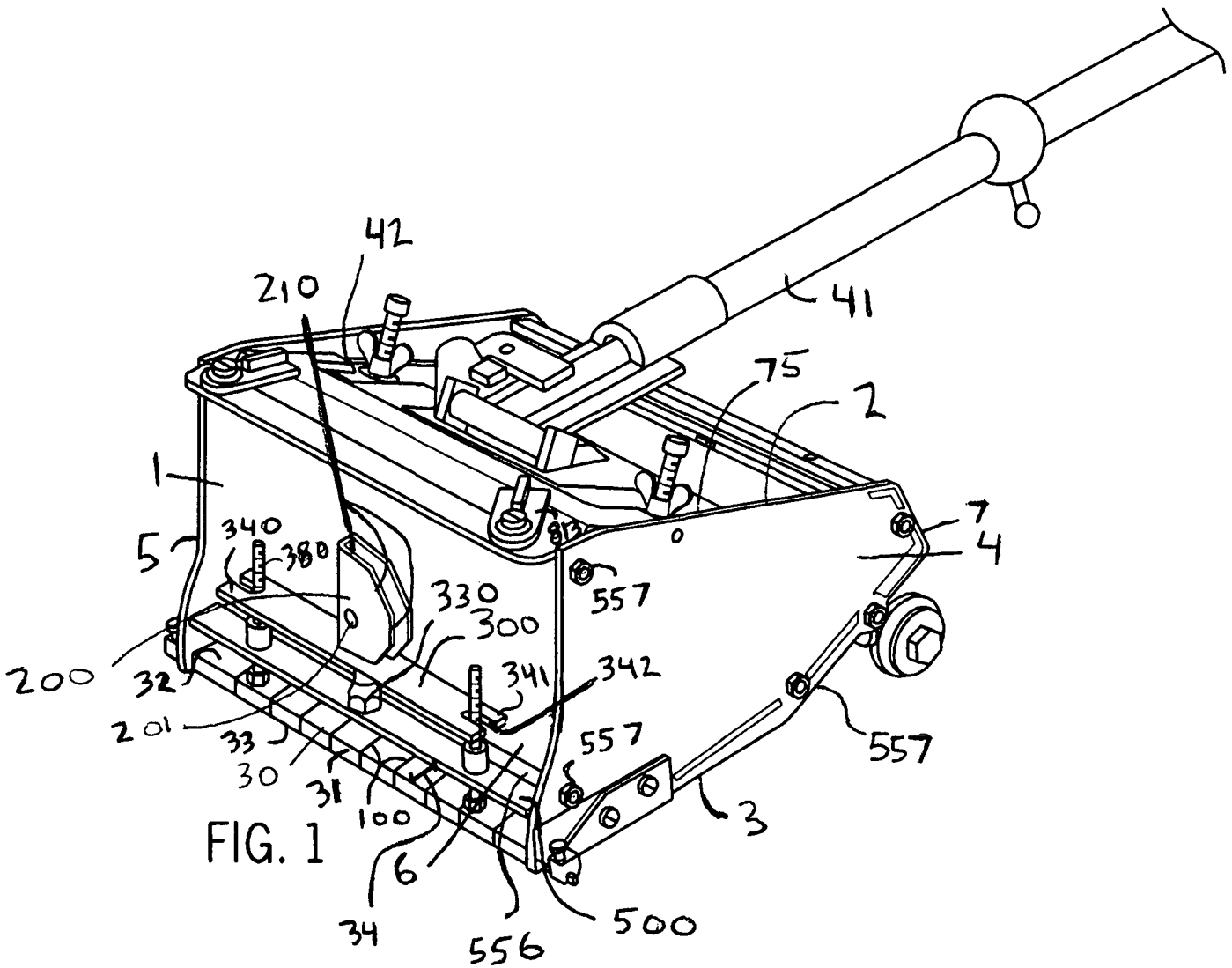
FIG. 1 illustrates a top perspective view of the flat box finisher wherein a handle is secured during use.

Referring now to FIG. 1, the flat box finisher 1 may have a top 2, a bottom 3, a first side 4, a second side 5, a front 6 and a back 7. The top 2 of the flat box finisher 1 may have a movable top plate 75 as described below. Although the shape may vary, the flat box finisher 1 may be roughly rectangular/wedged in shape. Further, although construction materials may vary, the flat box finisher 1 may be constructed largely from metal, having plastic and rubber as components secured together by screws, glue or the like.

Figure 3:
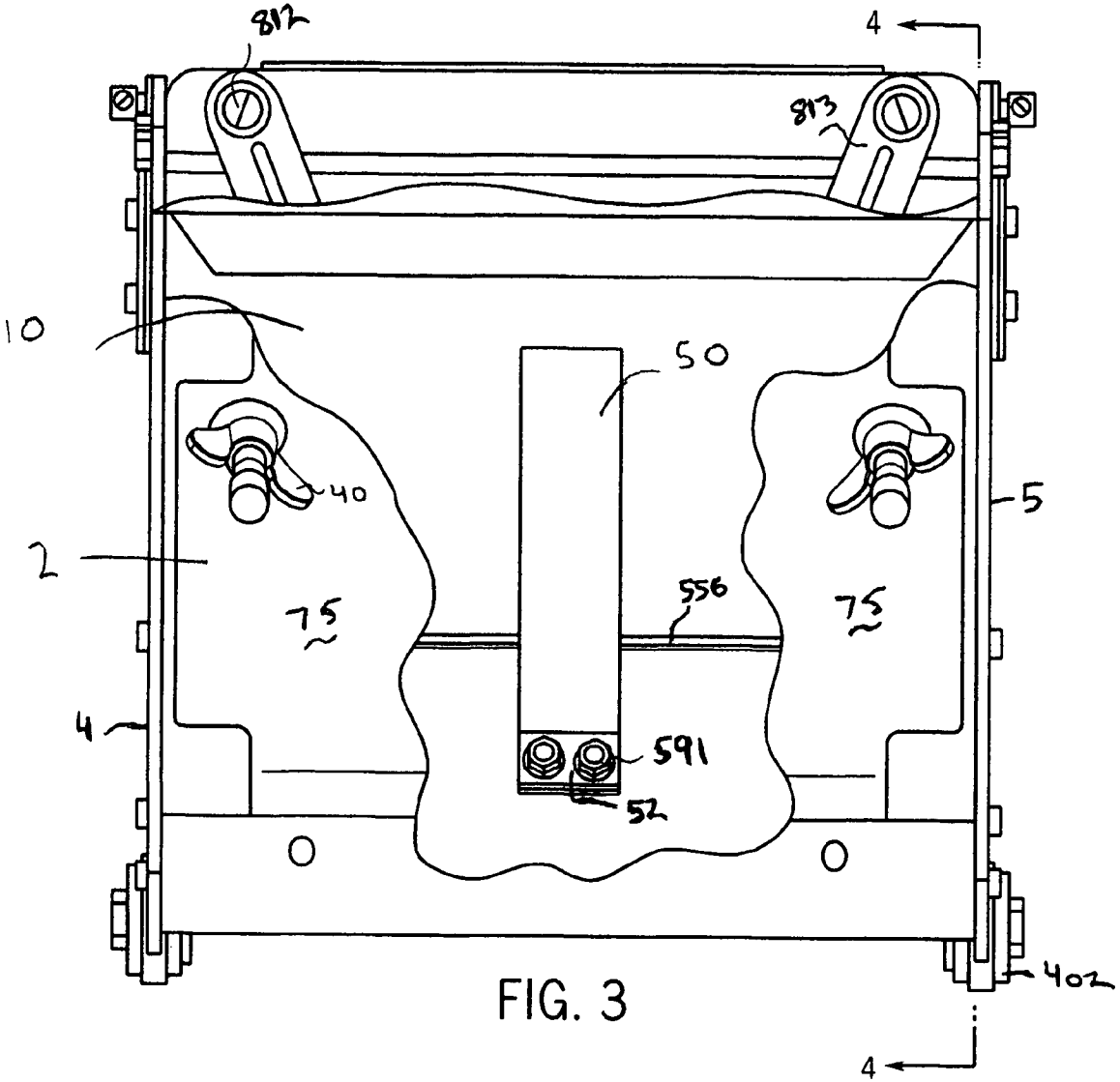
FIG. 3 illustrates a top plan view of the flat box finisher wherein the interior is partially exposed.

The flat box finisher 1 may have a generally hollow interior 10 (FIG. 3). During use, the generally hollow interior 10 of the flat box finisher 1 may be filled with a mud 11 (or mastic) which may be applied to the tape of the drywall. As use progresses, the mud 11 within the interior 10 of the flat box finisher 1 may be constantly removed from the interior 10 via an opening 20 and may be applied to the wall or ceiling. Periodically, the mud 11 may be replaced via the opening 20 with new mud 11 from a container via a tube (not shown). More specifically, a user may pump mud 11 into the interior 10 of the flat box finisher 1 via the opening 20 prior to use. Therefore, the mud 11 may both be inserted into the opening 20 via a pump (or manually) and may exit the opening 20 during use by applying pressure on the top plate 75 via the handle 41 (as discussed below).

Figure 5:
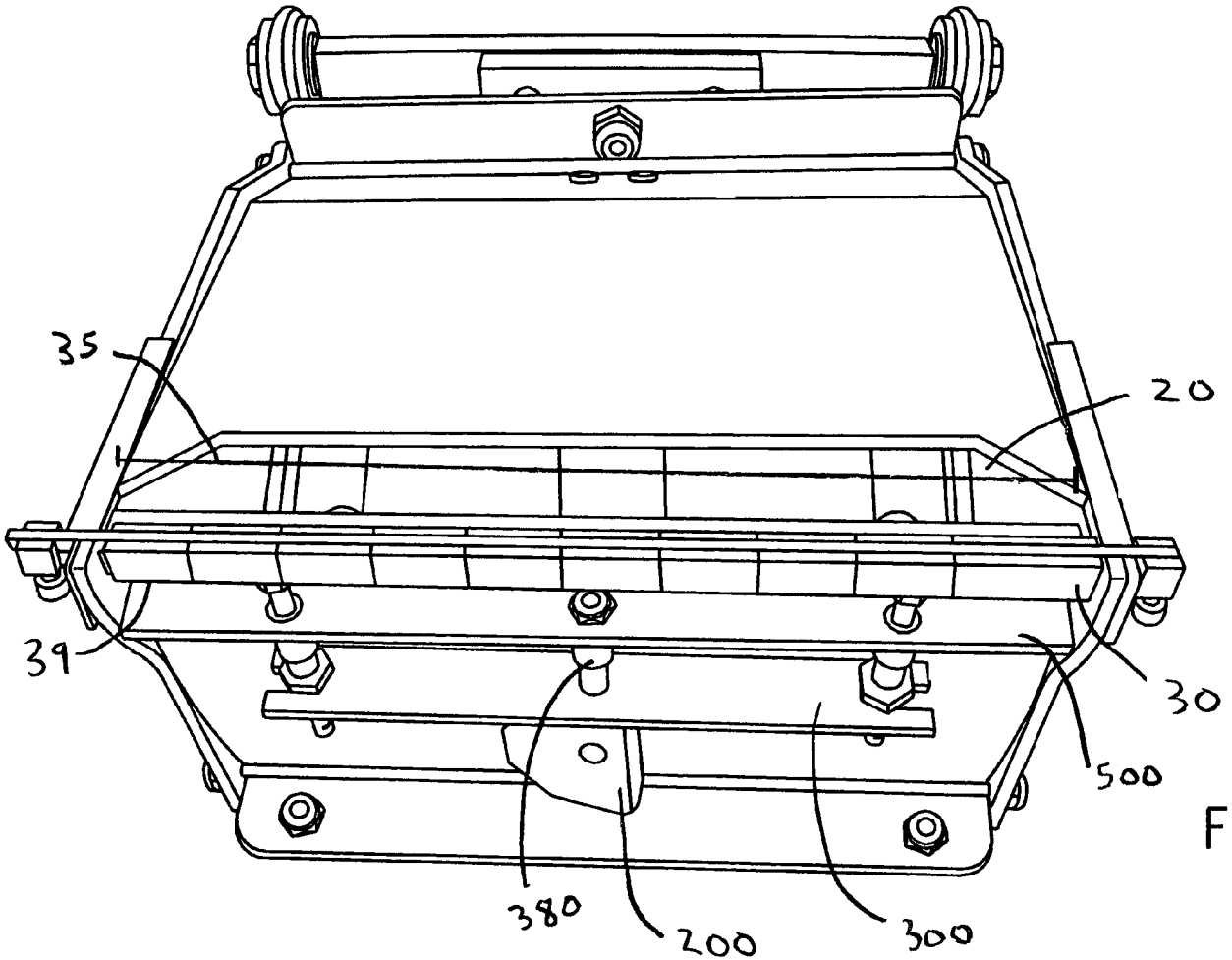
FIG. 5 illustrates a bottom plan view of the flat box finisher.

The flat finisher 1 may have an opening 20 (as shown in FIG. 5) which may be a generally elongated rectangular in shape and may run parallel to the top 2 and bottom 3 of the flat finisher 1. More specifically, the opening 20 may run, for example, along the bottom 3 of the flat box finisher 1 near the front 6 of the flat box finisher 1. While the mud 11 exits the opening 20, the mud 11 may take the shape of the opening 20 and may form, for example, a long thin streak over drywall tape. It is important that the opening 20 of the flat box finisher 1 be somewhat slim so that the amount of mud 11 applied to the tape is not too thick and may both dry and be smoothed efficiently.

A trowelling bar 30 may be located near the bottom 3 of the flat box finisher 1. More specifically, the trowelling bar 30 may be located at the front 6 of the flat box finisher 1, near the bottom 3. The trowelling bar 30 may have a front 31, a top side 32, a bottom side 33, a width 34 and a length 35 (as shown in FIG. 5). The trowelling bar 30 may help smooth the mud 11 exiting the opening 20 of the flat box finisher 1 onto the wall or ceiling. The trowelling bar 30 is generally located just behind the opening 20 (closer to the front 6) such that as the mud 11 is applied to the tape and exists the opening 20, the trowelling bar 30 smoothes over the mud 11 almost immediately after the mud 11 exits the opening 20. The front 31 of the trowelling bar 30 may act as a blade which may come into direct contact with the mud 11. The trowelling bar 30 may have a plurality of slits 100 which may run generally perpendicular to the length 35 of the trowelling bar 30. The plurality of slits 100 may surround the trowelling bar 30 such that they are present on the top 32, bottom 33, front 33 and back 39 (as shown in FIG. 5) of the trowelling bar 30. The plurality of slits 100 may allow the trowelling bar 30 to slightly bend up and down along its length 35.

As shown in FIG. 1, a pressure adjuster knob 200 may be located on the front 6 of the flat box finisher 1. The pressure adjuster knob 200 may rotate around a stationary pin 201. A support shaft 330 may have an opening (not shown) which secures the stationary pin 201 and allows the pressure adjuster knob 200 to rotate around the stationary pin 201. The support shaft 330 may pass through a pressure bar 300 (as described below). The pressure adjuster knob 200 may have a plurality of flat sides 210. FIG. 1 illustrates six flat sides. The plurality of sides 210 of the pressure adjuster knob 200 may be increasingly distant from the stationary pin 201 such that when the pressure adjuster knob 200 is rotated around the stationary pin 201 in a clockwise or counter-clockwise direction, the flat side 210 which contacts the pressure bar 300 is changed and the pressure which the pressure adjuster knob 200 exerts on the pressure bar 300 is increased or decreased, depending on the desired use.

As stated above, the pressure bar 300 of the device 1 may act as a spring which applies pressure exerted on it by the pressure adjuster knob 200 onto the trowelling bar 30 via a bolt 380 (FIG. 1 illustrates two bolts 380). The greater the distance between the stationary pin 201 and the pressure bar 300 (as determined by rotating the pressure adjuster knob 200 so that a side 210 having a greater distance is facing the pressure bar 300), the more pressure is created on the pressure bar 300 and, in turn, the trowelling bar 30. As a result, the trowelling bar 30 is forced closer to the wall or ceiling and the amount of mud 11 removed from the wall or ceiling is increased. Therefore, the greater the setting on the pressure adjuster knob 200, the more mud 11 is removed from the wall or ceiling and the thinner the mud 11 trail remains on the wall or ceiling.

The pressure bar 300 of the flat box finisher 1 may be generally rectangular and have a first end 340 and a second end 341. The pressure bar 300 may run substantially parallel with respect to the trowelling bar 30. The first end 340 and the second end 341 of the pressure bar 300 may each have a slot forming an opening 342. The opening 342 of both the first end 340 and second end 341 may each receive the shaft 380. Each shaft 380 may extend through the pressure bar 300, through a brace 500 (as defined below) to the trowelling bar 30. An opening (not shown) in the middle of the pressure bar 300 may allow the support shaft 330 to pass through; connecting the pressure adjuster knob 200 to the brace 500.

Figure 4:
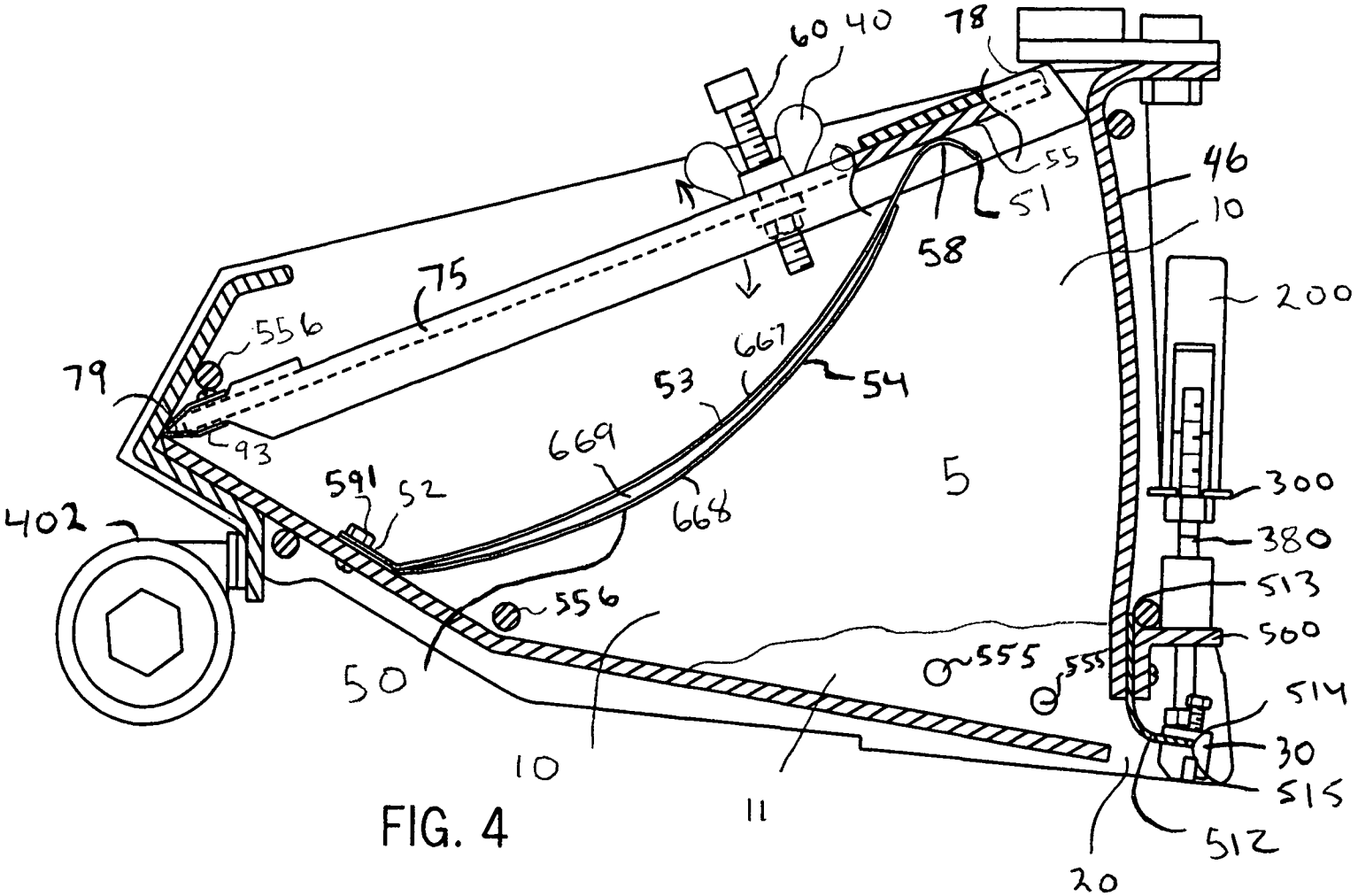
FIG. 4 illustrates side plan view of the flat box finisher wherein the interior is visible.

The brace 500 of the device 1 may attach the trowelling bar 30 to the flat box finisher 1 via a gasket 512 (FIG. 4). In an embodiment, the gasket 512 is made from rubber. The gasket 512 may have a first end 513 and a second end 514. The first end 513 of the gasket 512 may be secured between the front plate 46 and the brace 500. The second end 514 of the gasket 512 may be secured within an opening slit 515 of the trowelling bar 30. The gasket 512 may help guide the mud 11 out of the interior 10 (through the opening 20) of the flat box finisher 1 and onto the wall or ceiling.

Figure 2:
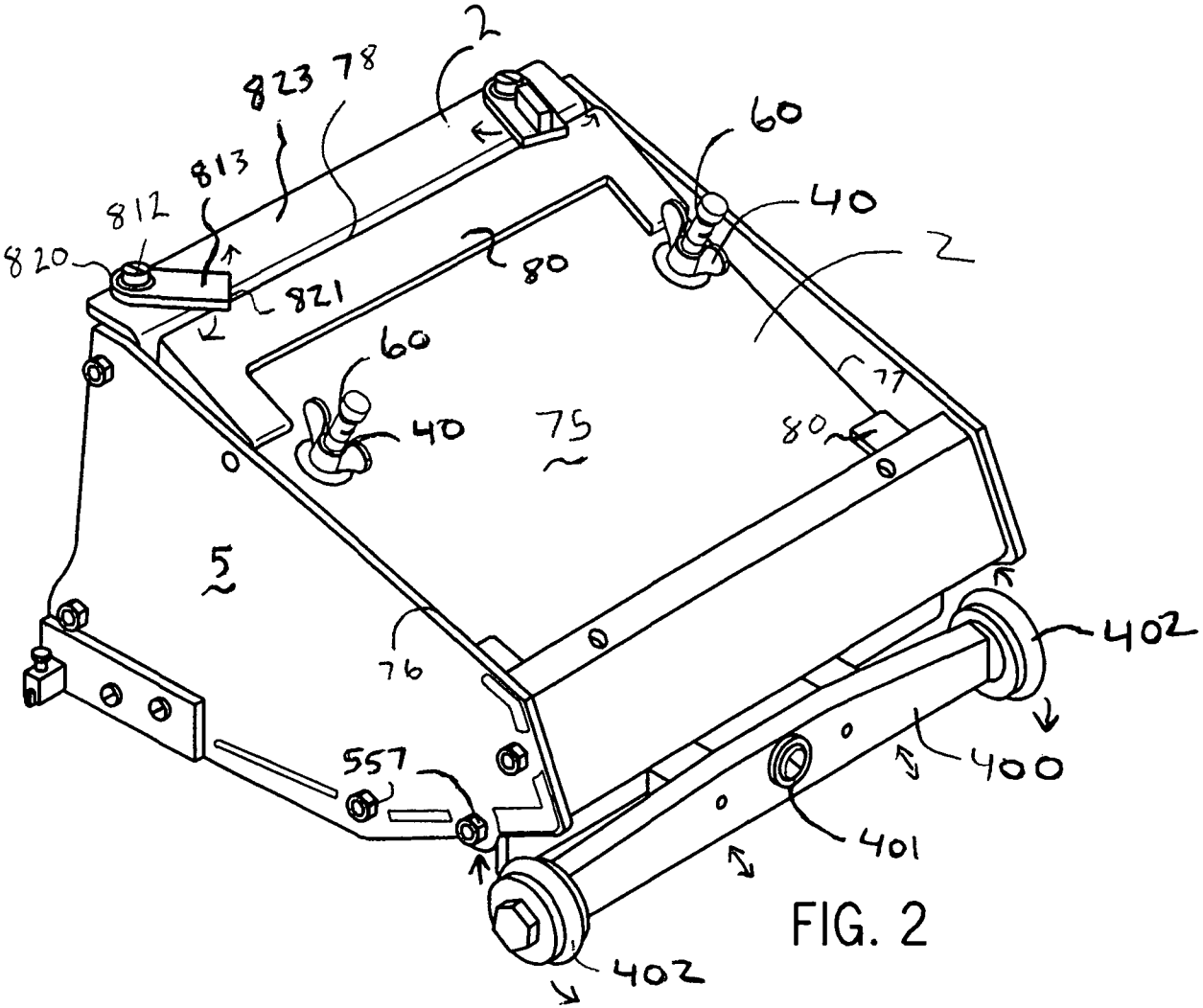
FIG. 2 illustrates a top perspective view of the flat box finisher wherein no handle is secured.

Referring now to FIG. 2, the back 7 of the flat box finisher 1 may be generally wedge-shaped and may have a rolling bar 400. The rolling bar 400 may be secured to the flat box finisher 1 by a central bolt 401. As a result, the rolling bar 400 may rotate slightly up or down around the central bolt 401. Each side of the rolling bar 400 may have a wheel 402. The wheel 402 may be generally made from, for example, rubber. The wheels 402 of the rolling bar 400 may contact the wall during use of the flat box finisher 1. The slight rotation up or down of the rolling bar 400 may allow the flat box finisher 1 to smoothly run along a wall or ceiling which may not be perfectly smooth or straight.

Located on the top 2 of the flat box finisher 1 may be a plurality of securing devices 40. More specifically, the plurality of securing devices 40 may be located on the top plate 75 of the device 1. The securing devices 40 may be, for example, a series of wing nuts secured on a bolt 60. FIG. 2 illustrates two securing devices 40; however, any number of securing devices 40 may be used. The securing devices 40 may secure, for example, a flat box finishing handle 41 and frame (FIG. 1).

A plurality of locking mechanisms 813 may be located on the top 2 of the device 1. The locking mechanisms 813 may have a first side 820 and a second side 821. The locking mechanism 813 may rotate around a bolt 812 located near the first side 820. The bolt 812 may allow the locking mechanism 813 to move from a first position A to a second position B. In the first position A, a portion of the second side 821 of the locking mechanism 813 may extend over a portion of a border 80 and/or the top plate 75; therein preventing the top plate 75 from being removed from the device 1 and further only allowing the top plate 75 to move downward. When in the second position B, no portion of the second side 821 of the locking mechanism 813 may extend over a portion of the border 80 and/or the top plate 75. As a result, in the second position B, the top plate 75 may be removed entirely from the main body of the device 1 and the interior 10 of the device 1 may be easily accessible for maintenance and/or cleaning.

Figure 6:
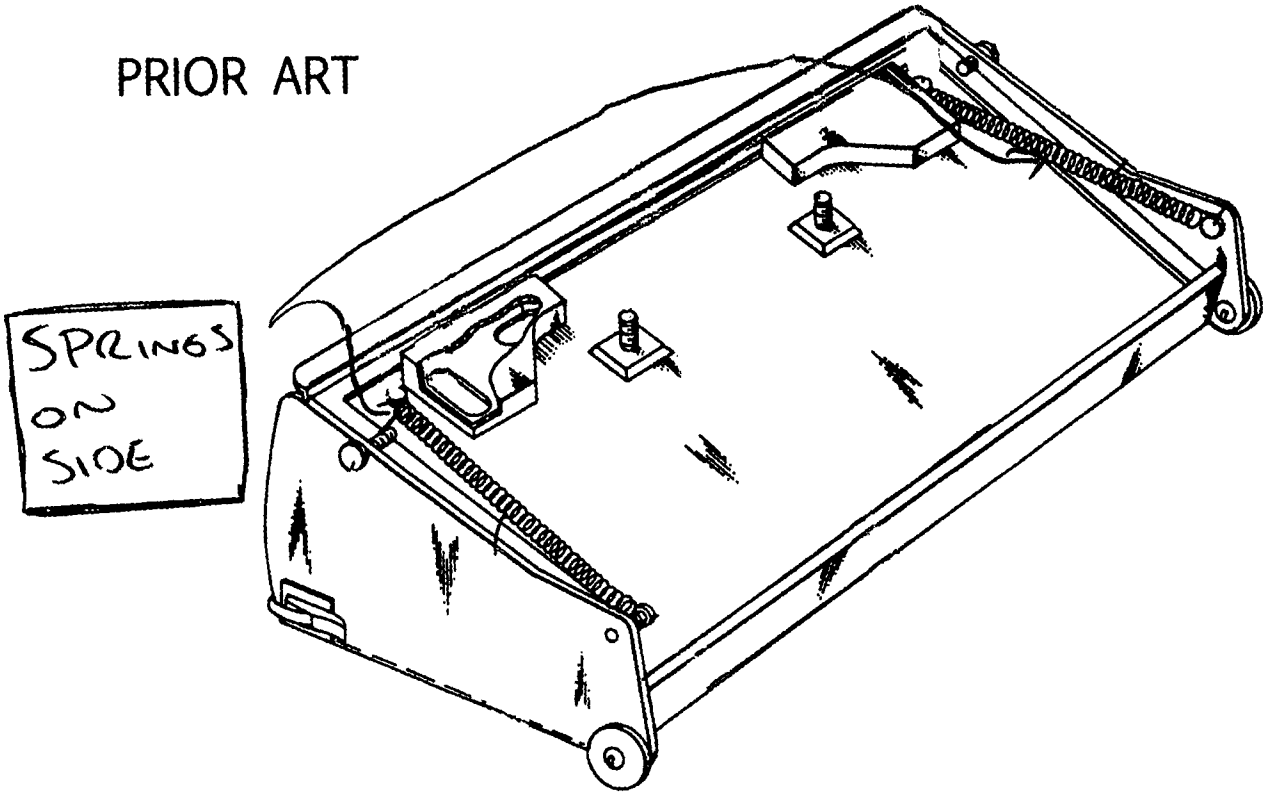
PRIOR ART FIG. 6
FIG. 6 illustrates the prior art of flat box finishers wherein springs are present on the top plate.

Typically, on existing flat box finishers, the flat box finishing handle 41 (having a frame) is secured to the top plate 75 of the flat box finisher 1 between to two springs (see prior art FIG. 6). The springs allow the user to apply pressure to the mud 11 in the generally hollow interior 10 of the flat box finisher 1 and further allow the user to help manipulate the direction, speed and accuracy of the flat box finisher 1 and thereby control the exit of mud 11 out of the opening 20 and onto the tape of the drywall. The problem with existing flat box finishers is that the top plate 75 surface of the device 1 must accommodate the flat box finishing handle and frame 41 in addition to the springs. As a result, the surface area of the top plate 75 of the flat box finishing device 1 must be rather large (see prior art FIG. 6). By the present device 1, as a result of an internal flexible support bar 50 (FIGS. 3 and 4) which acts as a spring, the springs on the top plate 75 of a typical flat box finisher may be removed and the surface area of the top plate 75 greatly reduced. More specifically, the sides of the top plate 75 may be brought in such that the wing nut securing devices 40 may be located very close to the first side 4 and the second side 5 of the device 1.

Referring now to FIGS. 3 and 4, as stated above, located within the generally hollow interior 10 of the flat box finisher 1 may be at least one flexible support bar 50. The flexible support bar 50 (or bars) may have a first side 51, a second side 52, a top 53 and a bottom 54. The second side 52 of the flexible support bar 50 may be secured, for example (within the interior 10 of the flat box finisher 1) near the bottom 3 and back 7 of the device 1. More specifically, the support bar 50 may be permanently secured to the bottom 3 of the device 1 by, for example, a plurality of bolts 591. In an embodiment, there may be a first layer 667 and second layer 668 to the support bar 50. Providing two layers attached to each other (with a space in the middle 669) may increase the flexibility of the support bar 50. It should be understood that a support bar 50 having one layer (FIG. 3) or more than three layers may be used.

Near the first side 51 of the flexible support bar 50 may be a curved portion 58 which may increase the surface area of the first side 51 which contacts the underside 55 of the top plate 75. The first side 51 of the support bar 50 may not be secured to any surface, but may simply contact and apply force to the underside 55 of the top plate 75 of the flat box finisher 1. Because of tensions built into the flexible support bar 50 (or bars) the first side 51 of the support bar 50 may provide tension and may force the underside 55 of the top plate 75 of the flat box finisher 1 upward and away from the bottom 3 of the flat box finisher 1. Placing the flexible support bar 50 within the generally hollow interior 10 of the flat box finisher 1 (and directly under the top plate 75) allows a manufacturer to remove springs which are normally found on the top side of the top plate 75 of the device 1, while still providing a spring like tension within the device 1. As a result, the surface area of the top plate 75 of the flat box finisher 1 may be reduced while still being large enough to accept standard flat box finishing handle 41.

The support bar 50 may be generally rectangular in shape and may be slightly curved. The support bar 50 is preferably made of a non-corrosive metal due to repeated exposure to moisture contained in the mud 11 held within the interior 10 of the device 1. As stated above, the support bar 50 is formed with inherent tension such that it retains its original shape and acts as a spring to force the underside 55 of the top plate 75 upward and away from the bottom 3 of the device 1.

The support bar 50 is located generally in the middle of the hollow interior 10 and generally parallel with respect to the first side 4 and the second side 5 of the device 1. While at rest within the interior 10 of the device 1, when the top plate 75 is in place and in contact with the first side 51 of the support bar 50, the support bar 50 may be generally at an angle between approximately thirty to sixty degrees with respect to the bottom 3 of the device 1.

As stated above, the top 2 of the flat box finisher 1 may have a top plate 75 which may move from a first position A to a second position B. The top plate 75 may have a first side 76, second side 77, top 78 and bottom 79. The bottom 79 of the top plate 75 may be secured within an elongated generally u-shaped holder 93 (FIG. 4) which may extend substantially the entire length of the back 7 of the device 1. The top plate 75 may therein pivot and rotate up and down while the elongated generally u-shaped holder 93 is secured within a generally pointed surface located at the back 7 of the device 1. Therefore, the top 78 of the top plate 75 may generally move while the bottom 79 of the top plate 75 remains generally stationary within the elongated generally u-shaped holder 93. The elongated generally u-shaped holder 93 may create a seal preventing mud 11 from accidentally exiting the interior 10 of the device 1.

As stated above, the top plate 75 may move from a first position A to a second position B. While the interior 10 of the device 1 is completely or partially filled with mud 11, the mud 11 may force the underside 55 of the top plate 75 upward, away from the bottom 3 of the device 1. Further, the support bar 50 may provided added pressure to force the underside 55 of the top plate 75 upward, away from the bottom 3. When a user applies force to the handle 41, the force is transferred to the top of the top plate 75 which therein forces the underside 55 of the top plate 75 down (and against the support bar 50) and forces some of the mud 11 to exit the opening 20 as defined below. Therefore, mud 11 may be applied to the wall in a controlled manner. In the relaxed first position A, the top plate 75 may be forced by the support bar 50 upward, away from the bottom 3. In the second position B, the force the user applies to the handle 41 forces the top plate 75 down and the mud 11 out the opening 20.

The top plate 75 at the top 2 of the flat box finisher 1 may have a protective border 80. On typical flat box finishers, the border 80 completely extends around the perimeter edge of the top plate 75 of the top 2 of the flat box finisher 1. However, in an embodiment of the present device 1, the border 80 may only cover the top 78 and the bottom 79 of the top plate 75 and the border 80 may not be present on the first side 76 and second side 77. The border 80 may ensure that there is no leakage of mud 11 from the sides and top of the flat box finisher 1; therein ensuring an even ejection of mud 11 from the opening 20.

The front 6 of the device 1 may have a front plate 46. The front late 46 may be slightly curved so as to allow the top plate 75 to rotate downward toward the interior 10 of the device 1. More specifically, the front plate 46 may bow outward in an arc manner slightly mirroring the imaginary arc of a circle created by rotating the top plate 75 completely around the elongated generally u-shaped holder 93.

Referring again to FIG. 4, the first side 4 and second side 5 may have a plurality of openings 555. The openings 555 on the first side 4 may mirror the openings on the second side 5. A generally cylindrical bar 556 (FIG. 1) may extend from the first side 4 to the second side 5 of the device 1. The bar 556 may be secured by, for example, a nut 557 located on the outside of the first side 4 and second side 5. As a result, the device 1 may have a plurality of bars 556 which extend the length of the device 1. The bars 556 may create tension and hold the first side 4 and the second side 5 in place attached to the remaining panels of the device 1. Further, some of the bars 556 may be present outside the interior 10 of the device 1 while other bars 556 extend within the interior 10 of the device 1 and come into direct contact with the mud 11.

Referring now to FIG. 5, the opening 20 of the device 1 may allow the mud 11 in the interior 10 of the device 1 to exit the interior 10 of the device and be spread on the wall or ceiling. As the device 1 moves, the mud 11 exits the opening 20 and is smoothed out by the trowelling bar 30.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages. It is, therefore, intended that such changes and modifications be covered by the appended claims.

I claim:

1. A mud applying flat box finisher device comprising:

a housing having a top, a bottom, a front, a back, a first side, a second side and an interior;

a movable top plate substantially forming the top of the housing wherein the movable top plate moves from a first position to a second position and wherein the movable top plate has a top side and an underside;

a support bar having a first layer having a curved portion and having a second layer wherein the first layer and second layer are both located completely within the interior of the housing and wherein the first layer of the support bar is secured to the second layer of the support bar and wherein the first layer is longer than the second layer and wherein the support bar extends from the bottom of the housing to the underside of the movable top plate and wherein the support bar exerts pressure on the underside of the movable top plate and wherein the support bar bends upon pressure being exerted on the top side of the movable top plate and moves to a second position and wherein the support bar returns the movable top plate to a first position when the pressure is removed; and wherein the first layer of the support bar is permanently secured to the bottom of the housing and wherein the first layer of the support bar is not secured to the underside of the movable top plate and wherein the curved portion of the first layer of the support bar applies pressure to the underside of the movable top plate.

2. The flat box finisher of claim 1 further comprising:

a plurality of securing mechanisms located on the top side of the movable top plate wherein the securing mechanisms temporarily secure a flat box finishing pole to the top side of the movable top plate.

3. The flat box finisher of claim 1 further comprising:

a locking mechanism located on the top of the housing wherein the locking mechanism temporarily prevents the movable top plate from being removed from the housing.

4. The flat box finisher of claim 1 wherein the front of the housing is curved and wherein the curve of the front of the housing is substantially similar to an arc created by the movement of the support bar from the first position to the second position.

5. The flat box finisher of claim 1 further comprising:

a pressure adjuster knob located on the front of the housing wherein the pressure adjuster knob has a plurality of sides and wherein the pressure adjuster knob rotates around a stationary pin and wherein none of the plurality of sides are of equal distant away from the stationary pin.

6. The flat box finisher of claim 5 further comprising:

a support shaft at the front of the housing wherein the support shaft has an opening wherein the support shaft receives the stationary pin and wherein the support shaft passes through a generally rectangular flexible pressure bar.

7. The flat box finisher of claim 1 wherein the first side of the support bar has a curved surface and wherein the curved surface contacts the underside of the movable top plate.

8. The flat box finisher of claim 1 wherein the support bar is at an angle between thirty to sixty degrees with respect to the bottom of the housing.

9. The flat box finisher of claim 1 further comprising;

a rubber border on the top of the movable top plate wherein the rubber border extends on a top edge and a bottom edge of the movable top plate and wherein the rubber border is lacking on the sides of the moveable top plate.

10. The flat box finisher of claim 1 further comprising:

a first and a second wheel attached to exterior ends of a rolling bar which is attached to the housing and wherein the rolling bar runs substantially parallel with respect to the bottom of the housing and wherein the rolling bar pivots around a central bolt.

11. The flat box finisher of claim 1 further comprising:

a generally rectangular opening on the bottom of the housing wherein a mud mixture exits the interior of the housing through the generally rectangular opening.

12. The flat box finisher of claim 11 further comprising:

a rubber gasket located at the generally rectangular opening wherein the gasket directs the mud mixture onto a wall or ceiling.

13. The flat box finisher of claim 9 wherein the bottom edge of the movable top plate is secured in an elongated generally u-shaped holder which is secured to the bottom of the housing and wherein the elongated generally u-shaped holder pivots with respect to the bottom of the housing.

14. The flat box finisher of claim 1 further comprising:

a plurality of bars extending within the interior of the housing wherein the plurality of bars secures the first side of the housing to the second side of the housing.

15. The flat box finisher of claim 1 wherein the support bar is generally rectangular.

16. The flat box finisher of claim 1 further comprising:

a troweling bar having a length secured to the front of the flat box finisher wherein the troweling bar smoothes mud which exists the interior of the housing; and a plurality of slits along the length of the troweling bar wherein the plurality of slits increases the flexibility of the troweling bar.

17. The flat box finisher of claim 1 wherein the movable plate has a top, a bottom, a front, a back, a first side and a second side; and a securing border for securing the movable top plate wherein the securing boarder is located on and secured to the top of the housing wherein the securing border covers the entire front of the movable plate and wherein a securing boarder does not contact a portion of the first side and a portion of the second side of the movable plate.

18. The flat box finisher of claim 1 further comprising:

a hollow space between the first layer of the support bar and the second layer of the support bar wherein the movement of the first layer of the support bar with respect to the second layer of the support bar increase the overall flexibility of the support bar.

* * * * *